US012331432B2

(12) United States Patent
Dumas et al.

(10) Patent No.: US 12,331,432 B2
(45) Date of Patent: Jun. 17, 2025

(54) ELECTRICALLY CONDUCTIVE YARN AND WEARABLE ARTICLE INCLUDING SUCH YARN

(71) Applicant: CHRONOLIFE, Paris (FR)

(72) Inventors: Pascal Dumas, Versailles (FR); Stéphane Carras, Condé-sur-Noireau (FR)

(73) Assignee: CHRONOLIFE, Paris (FR)

( * ) Notice: Subject to any disclaimer, the term of this patent is extended or adjusted under 35 U.S.C. 154(b) by 0 days.

(21) Appl. No.: 17/641,208

(22) PCT Filed: Sep. 9, 2020

(86) PCT No.: PCT/EP2020/075209
§ 371 (c)(1),
(2) Date: Mar. 8, 2022

(87) PCT Pub. No.: WO2021/048211
PCT Pub. Date: Mar. 18, 2021

(65) Prior Publication Data

US 2024/0052533 A1 Feb. 15, 2024

(30) Foreign Application Priority Data

Sep. 9, 2019 (EP) ..... 19306079

(51) Int. Cl.
*A41D 1/00* (2018.01)
*D02G 3/32* (2006.01)
*D02G 3/44* (2006.01)

(52) U.S. Cl.
CPC ..... *D02G 3/32* (2013.01); *D02G 3/441* (2013.01); *A41D 1/005* (2013.01); *D10B 2401/061* (2013.01); *D10B 2401/18* (2013.01)

(58) Field of Classification Search
CPC ..... A41D 1/005; D02G 3/32; D02G 3/441
See application file for complete search history.

(56) References Cited

U.S. PATENT DOCUMENTS 34,862 A * 4/1862 Morgan ..... H01B 7/22
174/113 A
2,342,098 A * 2/1944 Alderfer ..... D02G 3/32
428/377

(Continued)

FOREIGN PATENT DOCUMENTS

CN 106917171 A 7/2017
DE 102018101561 B3 4/2019

(Continued)

OTHER PUBLICATIONS

Office Action issued on Jul. 25, 2024, in corresponding European Application No. 20 771 522.8, 7 pages.

(Continued)

*Primary Examiner* — Bao-Thieu L Nguyen
(74) *Attorney, Agent, or Firm* — Maier & Maier, PLLC

(57) ABSTRACT

Electrically conductive yarn, which includes an assembly of at least two resistive elements and a wrapping layer covering the assembly of the two resistive elements. Each resistive element includes an elastic core coated with metal. Also, a wearable article including a flexible support, at least one sensor for measuring a physiological parameter of the wearer of the wearable article, at least one of electrically conductive yarn stitched on the flexible support along a path from a respective sensor to a location for an electronic board, and connected to the at least one sensor, and at least one flexible strip attached to the flexible support along the path to protect the at least one electrically conductive yarn.

14 Claims, 2 Drawing Sheets

(56) References Cited

U.S. PATENT DOCUMENTS 3,387,500 A * 6/1968 Hutzenlaub ..... F16G 1/08 474/260
4,793,130 A * 12/1988 Togashi ..... D02G 3/12 57/210
10,299,520 B1 * 5/2019 Shaffer ..... A61B 5/6804
10,472,742 B1 * 11/2019 May ..... D02G 3/441
2005/0029680 A1 2/2005 Jung et al.
2005/0054941 A1 * 3/2005 Ting ..... A61B 5/6831 600/534
2005/0155336 A1 * 7/2005 Robins ..... D02G 3/441 57/210
2008/0091097 A1 * 4/2008 Linti ..... A61B 5/411 600/389
2008/0282665 A1 * 11/2008 Speleers ..... D02G 3/328 57/212
2008/0289312 A1 * 11/2008 Takada ..... A41D 19/01511 57/232
2011/0138523 A1 * 6/2011 Layson, Jr. ..... D03D 15/52 139/384 R
2012/0060963 A1 * 3/2012 Song ..... D04B 1/16 57/212
2013/0227757 A1 * 9/2013 Chen ..... A41D 13/0051 2/69
2014/0363656 A1 * 12/2014 Kunisada ..... D02G 3/441 428/221
2015/0177080 A1 * 6/2015 Esposito ..... A61B 5/01 73/862.01
2015/0250420 A1 * 9/2015 Longinotti-Buitoni ..... A61B 5/1135 600/534
2016/0095369 A1 * 4/2016 Roberts ..... A41D 19/01535 2/160
2017/0036066 A1 * 2/2017 Chahine ..... A41D 1/002
2017/0086519 A1 * 3/2017 Vigano' ..... A63B 71/141
2017/0135416 A1 5/2017 Kang et al.
2017/0238636 A1 * 8/2017 Einesson ..... A41D 13/08
2018/0184735 A1 * 7/2018 Longinotti-Buitoni ..... A61B 5/282
2018/0258562 A1 9/2018 Fukuhara
2018/0344171 A1 * 12/2018 Straka ..... A61B 5/01
2018/0369637 A1 * 12/2018 Hoang ..... G09B 19/003
2019/0037943 A1 * 2/2019 Binshu ..... D02G 3/442
2019/0216147 A1 * 7/2019 Lamontia ..... H05B 3/342
2019/0223288 A1 * 7/2019 Wu ..... B32B 3/08
2019/0327832 A1 * 10/2019 Holbery ..... H05K 3/284
2020/0106437 A1 * 4/2020 Iso-Ketola ..... H05K 1/0283
2020/0347525 A1 * 11/2020 Kaneko ..... H02N 10/00
2020/0347527 A1 * 11/2020 Konukoglu ..... D02G 3/36
2020/0367823 A1 * 11/2020 Chahine ..... A41B 11/00
2021/0071323 A1 * 3/2021 Hu ..... D02G 3/36
2022/0087607 A1 * 3/2022 Ganesan ..... B32B 5/26
2024/0016234 A1 * 1/2024 Amadio ..... A41B 11/00
2024/0066334 A1 * 2/2024 Mollmann et al. ..... B32B 37/16

FOREIGN PATENT DOCUMENTS

EP 1327709 A1 7/2003
EP 2236654 A1 10/2010
EP 3502327 A1 6/2019
WO 2009037631 A1 3/2009
WO 2017129864 A1 8/2017
WO 2018202905 A1 11/2018
WO 2019130477 A1 7/2019

OTHER PUBLICATIONS

International Search Report and Written Opinion issued on Dec. 4, 2020 in corresponding International Patent Application No. PCT/EP2020/075209; 10 pages.

* cited by examiner

ELECTRICALLY CONDUCTIVE YARN AND WEARABLE ARTICLE INCLUDING SUCH YARN

FIELD

The present disclosure generally relates to the field of conductive textile technology and, in particular, relates to an electrically conductive yarn, particularly conductive yarn usable to connect elements in garments or other kinds of wearable articles.

BACKGROUND OF THE INVENTION

Electronic devices for detecting and processing biometric signals of a user have been developed that allow medical supervision of people during their usual activities or situations. Sensors may be applied to the skin or specific body area, for example chest, of a user so as to perform temperature measurement, to determine physiological parameters or to detect electrical signals related for example to a cardiac function. Monitoring the various signals delivered by these sensors allows determining user specific physiological condition that might be impaired. For example, when an individual is having a seizure, specific signal features appear on the signals corresponding to the electrocardiogram (ECG) or to respiration.

Certain types of wearable articles have thus been developed that need to have conductive parts to electrically connect elements such as sensors, electrodes, transducers, haptic components, light sources, etc.

Different kinds of physiological sensors can be included in a garment or some other wearable article, such as a breathing sensor or an electrode. The electric connection of these sensors to an electronic board, an electrical source or other entities can be complex.

Conductive yarn can be used to connect sensors and other devices in wearable articles. Such yarn should fulfill several requirements, such as robustness, flexibility, thermal stability and conductivity.

DE 10 2018 101 561 discloses an electrically conductive yarn that comprises two helically wound threads, wherein each thread comprises at least one electrically conductive yarn and at least one electrically non-conductive base yarn. The electrically conductive yarn comprises the electrically non-conductive base yarn which is coated with an electrically conductive material and coated with water-soluble plastic. It has a relatively large diameter.

Conventional conductive yarns used in the textile industry are mostly based on metallic wires (copper, stainless steel, aluminum, etc.). They often lack flexibility.

To enable use in textile industry, it is desirable that the yarns can be repeatedly deformed without breaking. In particular, large deformations occur when the yarn is sewn or knitted. Additionally, during sewing step, friction occurs at the sewing eye which can damage the thread and impact its conductive properties. Therefore, in practice, existing conventional conductive yarn cannot be easily sewn or incorporated in fabrics and wearable articles.

Moreover, washing of wearable articles incorporating such yarn causes repeated friction and can impair the durability of the electrical connection function. So the yarn needs to be robust in the long term, even if the wearable article incorporating it undergoes severe friction. It should also be unaffected by the detergents used for washing and to the sweat during wearing.

Accordingly, a need exists for an electrically conductive yarn that alleviates one or more of the above-mentioned difficulties.

SUMMARY

An electrically conductive yarn is disclosed. The electrically conductive yarn comprises an assembly of at least two resistive elements and a wrapping layer, wherein each of said resistive element comprises metal-coated elastic core and wherein said wrapping layer is covering the assembly of the at least two resistive elements. The wrapping layer comprises at least two covering threads arranged helically around the assembly of the two resistive elements in opposite directions and in contact with each other.

In an embodiment, the elastic core is based on polyamide fibers and is coated with a metal, for example in the group of silver and gold. In one embodiment, such metal is silver.

The term "coated with metal" and "metal-coated" must be understood as meaning "coated with metallic layer", "coated with metal particle" as well as "coated with metallic layer formed by depositing a plurality of metal particles".

In one embodiment, the resistive elements have a twisted arrangement with 0.2 to 0.4 turns per mm, preferably 0.3 turns per mm.

The covering threads protect the assembly of the resistive elements from friction and chemical agents, and minimize wear.

In an embodiment, the covering threads are non-conductive threads. For example, they may be made of synthetic yarns, such as yarns of Polyvinyl Alcohol (PVA) family.

In one embodiment, the two covering threads have a twisted arrangement with 0.7 to 0.9 turns per mm.

In one embodiment, the electrically conductive yarn has a resistance smaller than about 220 Ω/m, preferably between about 150 and about 180 Ω/m, even more preferably is about 172 Ω/m.

The term "about" as used herein means within 20%, preferably within 10%, and more preferably within 5%. In specific cases, "about X", means "X".

The electrically conductive yarn can be part of a flexible support.

The electrically conductive yarn can be stitched to a flexible support and allows electrically connecting components such as electrodes, sensors and various electronic devices.

The present invention further provides a wearable article, e.g. clothing item, such as a T-shirt, comprising:

- a flexible support;
- at least one sensor for measuring a physiological parameter of a wearer of the wearable article and/or an electronic board;
- at least one electrically conductive yarn of the Invention, stitched on the flexible support to the at least one sensor and/or to the electronic board; and at least one flexible strip attached to the flexible support along the path to protect the at least one electrically conductive yarn.

In that wearable article, the at least one electrically conductive yarn comprises:

- an assembly of at least two resistive elements, each resistive element comprising a metal-coated elastic core; and
- a wrapping layer covering the assembly of the at least two resistive elements.

In one embodiment of the wearable article, the at least one sensor comprises an electrode having a flexible conductive matrix, and the at least one electrically conductive yarn is connected to the flexible conductive matrix by sewing.

In one embodiment of the wearable article, the at least one sensor comprises an elongation sensor comprising an elastic core and two resistive elements arranged helically around the elastic core in opposite directions and in contact with each other. The elongation sensor can be used to detect the breathing or muscle activity (contraction/relaxation) of a wearer.

In one embodiment of the wearable article, the electronic board has a conductive edge portion. Holes are provided in the conductive edge portion, and the at least one electrically conductive yarn is connected to the electronic board by sewing to the conductive edge portion through at least one of the holes.

In one embodiment of the wearable article, the conductive edge portion comprises at least one terminal part for connection to a respective sensor. A plurality of holes are formed in the terminal part, and an electrically conductive yarn is connected to the terminal part by insertion into the holes. Each hole in the edge portion is dedicated to the connection of a specific sensor to the electronic board.

In one embodiment of the wearable article, the at least one electrically conductive yarn is stitched on the flexible support along a path, e.g. from a respective sensor to the electronic board, and at least one flexible strip is adhered to the flexible support along the path to protect the at least one electrically conductive yarn.

In one embodiment of the wearable article, a first flexible strip is bonded to the side of the wearable article facing the skin of a wearer, and a second flexible strip is bonded to the opposite side. At least one of the flexible strips may be stitched to the flexible support.

BRIEF DESCRIPTION OF THE DRAWINGS

The accompanying drawings, which are incorporated herein and form part of the specification, illustrate the present invention and, together with the description, further serve to explain the invention and to enable a person skilled in the pertinent art to make and use the invention. In the drawings, like reference characters indicate identical or functionally similar elements.

DETAILED DESCRIPTION

Figure 1:
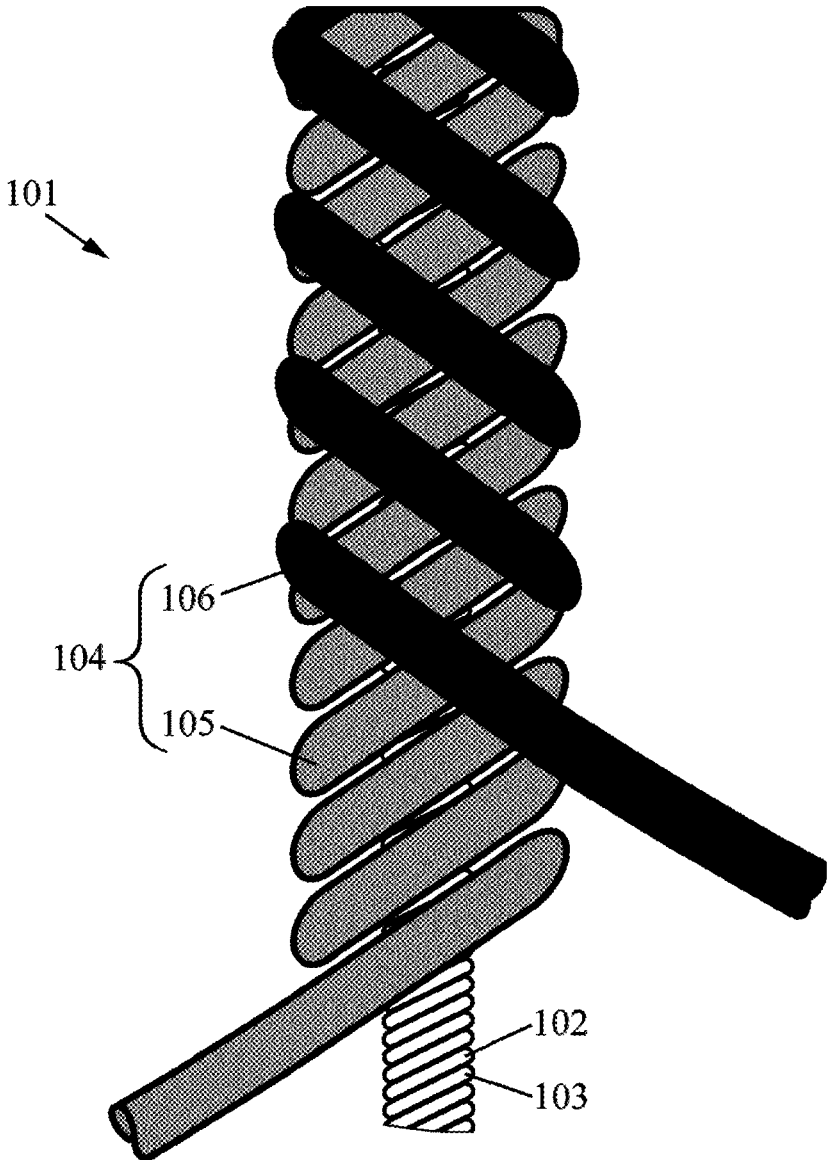
FIG. 1 shows a schematic representation of an electrically conductive yarn.

FIG. 1 shows a schematic representation of an electrically conductive yarn 101 according to one embodiment of the invention.

An electrically conductive yarn 101 may be fabricated from two resistive elements 102, 103 in the form of threads. For assembling the resistive elements 102, 103, a twisted arrangement can be used, the resistive elements being intertwined around each other. A typical pitch for the twisted arrangement is about 0.5 mm, corresponding to about 300 turns per m.

Alternatively, more than two resistive elements can be assembled in the electrically conductive yarn 101.

The resistance value of the assembly of the resistive elements 102, 103 is dependent on the application and on the geometrical configuration of the article, such as a wearable article, incorporating the conductive yarn. Typically, the resistance is smaller than 220 Ω/m.

By way of example, threads provided by Noble Biomaterials under the trade name Circuitex may be used as the resistive elements 102, 103. A Circuitex thread has a flexible core made of polyamide, coated with a silver layer.

Due to their mechanical properties, polymer materials such as polyamide are adapted for this application. A metallic coating of the flexible core confers conductive properties to the thread while maintaining its flexibility. In comparison to other metals, silver has favorouble electrical and mechanical properties. According to special embodiment, the individual Circuitex thread has a resistance of 300 Ω/m.

The twisted assembly of the resistive elements 102, 103 is surrounded by a wrapping layer 104. In an embodiment, the wrapping layer 104 is made from a pair of covering threads 105, 106 disposed around the assembly of the resistive elements 102, 103. A first covering thread 105 is wrapped around the assembly 102, 103 to form an inner cover, and then a second covering thread 106 is wrapped around the inner cover to form an outer cover.

Each covering thread 105, 106 of the wrapping layer 104 may be twisted with a twisting parameter of about 800 turns per meter.

The wrapping layer 104 reinforces the assembly and avoids its unravelling. It makes the yarn 101 more suitable for sewing, knitting or stitching.

In the above-cited example, the assembly of two Circuitex resistive elements 102, 103 are wrapped with two Solvron covering threads 105, 106. Solvron is the trade name of a synthetic thread made of polyvinyl alcohol provided by NITIVY CO., LTD. The twisting parameter may vary between 744 and 856 T/m with an average value of 800 T/m.

An electrically conductive yarn 101 as described above can be used for sewing, for example with a sewing machine, or stitching.

It is advantageously incorporated in wearable articles, in particular garments. The structure of the conductive yarn is appropriate for withstanding frictional forces undergone by the thread during sewing or by the garment during washing cycles. Additional protective means may be provided to further protect the conductive yarn, such as flexible strips discussed below with reference to FIG. 2.

Figure 2:
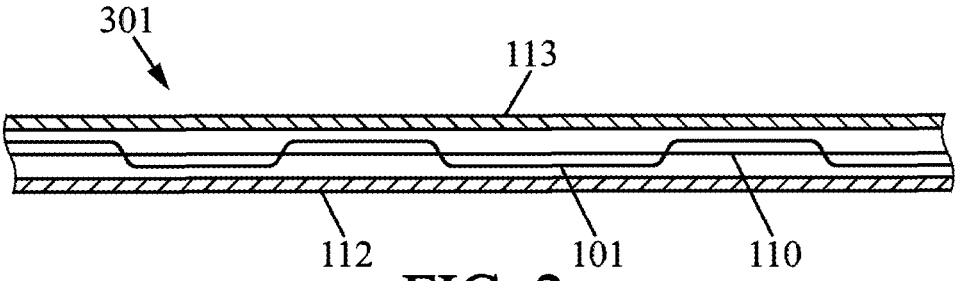
FIG. 2 shows a schematic representation of flexible strips bonded to a flexible support.

FIG. 2 is a schematic cross-sectional view of a part of a wearable article in which an electrically conductive yarn 101 is disposed. In the discussion which follows, the wearable article is a garment 301, more particularly a vest or a T-shirt, but the invention is not limited thereto.

A flexible support 110 typically made of woven fabric forms the main part of the garment. Electrically conductive yarns 101 are stitched on the flexible support 110 along predetermined paths to provide electrical connection of components carried by the garment.

To protect the yarn 101 from wear and to protect the wearer's skin, it is covered on both sides of the support 110 by flexible strips 112, 113. On the inside of the garment (side that is in contact with the wearer's skin), the strip 112 may be formed of cotton fabric bonded to the flexible support 110. For example, the cotton strip may be fixed to the flexible support with topstitches. On the outside of the garment, the strip 113 may be made of synthetic fabric (e.g. polyamide or elastane) bonded to the flexible support. The flexible strips 112, 113 may be bonded to the support 110 by a hot-melt adhesive method where the flexible strips are heated to a temperature of approximately 130°. The adhesive encapsulates the conductive yarn 101 to protect it from friction and from chemical agents, thus increasing the durability of the electrical conduction function.

Figure 4:
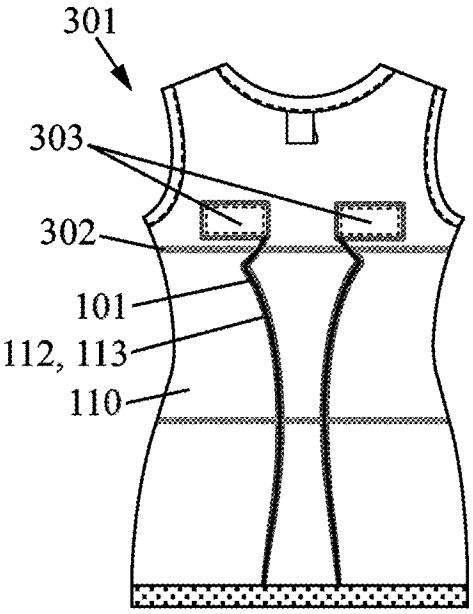
FIG. 3-4 are schematic views of the front side and the back side of a garment that includes an electrically conductive yarn and physiological sensors.
Figure 3:
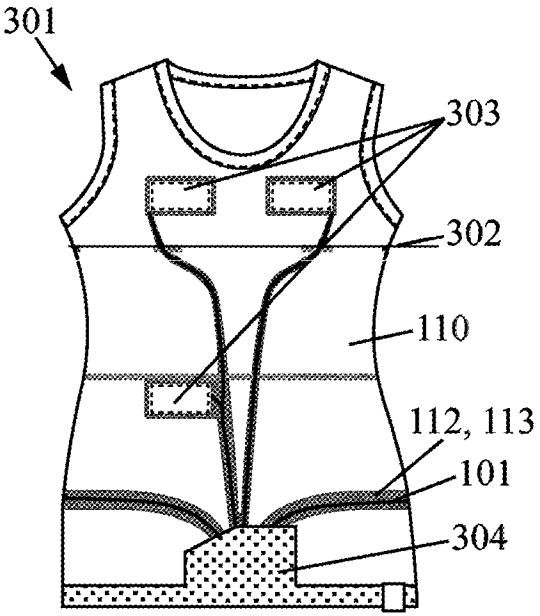

FIGS. 3-4 show an explanatory view of the front side (FIG. 3) and the back side (FIG. 4) of the garment 301, which is a T-Shirt in the present embodiment. The T-Shirt comprises sensors configured to detect physiological parameters. The T-Shirt has a flexible support 110 made of non-conductive fabric, like cotton/elastane or polyamide/elastane, for example. The flexible support 110 may contain between 6% and 12% of elastane such that the T-Shirt tightly fits the body of the wearer. This makes sure that the sensors included in the T-Shirt are in close contact with the wearer's skin.

A plurality of sensors may be integrated in the flexible support. For example two elongation sensors 302 to follow the breathing of a user and flexible electrodes 303 to measure electrical signals of the heart of a user, or electrical conductance values.

Each electrode 303 may comprise a body of flexible material having embedded conductive particles. For example, the body is made of silicone and the conductive particles are graphite particles. A surface of the body has an array of protrusions to be applied to the wearer's skin. Due to its flexibility and surface configuration, such an electrode adapts to the shape of the wearer's body while the wearer moves. The electrically conductive yarn can be sewn through the flexible body of the electrode in order to connect it to an electronic board 304 also carried by the T-shirt. Thus, the electrical connection is easily performed with no additional parts.

The two elongation sensors 302 may surround the T-Shirt at the height of the chest and the abdomen of a potential wearer, respectively. The position of the elongation sensors in the T-Shirt are chosen to evaluate the thoracic and abdominal respiration. The elongation sensors may be installed in a flexible sheath.

Two electrodes 303 are located on the front side (side that faces the chest) at the height of the wearer's chest, two electrodes 303 at the backside at the height of the chest, and one electrode 303 at the front side at the height of the abdomen. The use of five electrodes 303 allows to measure an electrocardiogram or other properties such as the amount of fat and water in a human body more precisely than with only two electrodes, pulmonary impedance or body temperature.

The sensors are connected by electrically conductive yarns 101 to an electronic board 304 which is installed in the T-Shirt in an integrated pocket. The electronic board is coupled to a battery.

The sensors and electrodes are disposed on the inner side of the T-Shirt (side that is in contact with the wearer's skin).

To prevent different electrically conductive yarns 101 from touching each other, a possibility is to use strips to separate different electrically conductive yarns from each other and to avoid any skin contact.

The electrically conductive yarn is covered by flexible strips 112, 113 as discussed with reference to FIG. 2. The strips 112, 113 are bonded to the flexible support 110 of the T-Shirt along the path of the yarns 101. The flexible strips may minimize wear, especially during washing of the T-Shirt. Furthermore, the wearer's skin is protected by these flexible strips. The flexible strips 112, 113 may be made of non-conductive elastic materials, like polyamide, cotton or elastane for example.

Physiological sensors integrated in the T-Shirt can acquire data continuously or when triggered. For example, the sensors can be configured to start acquisition when the rhythm or amplitude of heart beat changes. The acquired data can be transmitted to a user device such as a smartphone to analyze the data close to the wearer, or the data can be transmitted to a central processing unit where they are accessible by the user and/or by a medically qualified person.

The T-Shirt described in FIGS. 3-4 has many applications, for example in medicine to monitor the state of a patient to detect syndroms of an illness. It will find further applications in sports, where it can be used for example by a coach to survey the health conditions of the sportsperson.

The wearer can be a human or an animal, such as a dog for example.

It will be appreciated that the embodiments described above are illustrative of the invention disclosed herein and that various modifications can be made without departing from the scope as defined in the appended claims.

The invention claimed is:

1. A wearable article, comprising:

a flexible support;

at least one sensor for measuring a physiological parameter of a wearer of the wearable article;

at least one electrically conductive yarn stitched on the flexible support along a path from a respective sensor to a location for an electronic board, and connected to the at least one sensor; and at least one flexible strip attached to the flexible support along the path to protect the at least one electrically conductive yarn, wherein the at least one electrically conductive yarn comprises:

an assembly of at least two resistive elements, wherein each resistive element comprises a metal-coated elastic core; and a wrapping layer covering the assembly of the at least two resistive elements, wherein the at least one sensor comprises an electrode having a flexible conductive matrix, and the at least one electrically conductive yarn is connected to the flexible conductive matrix by sewing, the wearable article further comprising an electronic board attached to the flexible support, wherein the electronic board has a conductive edge portion, holes are provided in the conductive edge portion, and the at least one electrically conductive yarn is connected to the electronic board by sewing to the conductive edge portion through at least one of the holes.

2. The wearable article of claim 1, wherein the at least one sensor comprises an elongation sensor comprising an elastic core and two resistive elements arranged helically around the elastic core in opposite directions and in contact with each other.

3. The wearable article of claim 1, wherein the conductive edge portion comprises at least one terminal part for connection to a respective sensor, wherein a plurality of holes are formed in the terminal part, and wherein an electrically conductive yarn is connected to the terminal part by insertion into the holes.

4. The wearable article of claim 1, wherein the at least one flexible strip attached to the flexible support comprises a first flexible strip attached to the flexible support on the side of the wearable article facing the skin of a wearer and a second flexible strip attached to the flexible support on the opposite side of the wearable article.

5. The wearable article of claim 1, wherein the elastic core of each resistive element is coated with silver.

6. The wearable article of claim 1, wherein the resistive elements have a twisted arrangement with 0.2 to 0.4 turns per mm.

7. The wearable article of claim 1, wherein the assembly of the at least two resistive elements has a resistance less than about 220 Ω/m.

8. The wearable article of claim 1, wherein the wrapping layer covering the assembly of the at least two resistive elements comprises at least two covering threads arranged helically around the assembly of the two resistive elements in opposite directions and in contact with each other.

9. The wearable article of claim 8, wherein the at least two covering threads are non-conductive threads.

10. The wearable article of claim 8, wherein the at least two covering threads have a twisted arrangement with 0.7 to 0.9 turns per mm.

11. The wearable article of claim 8, wherein the wrapping layer comprises a first covering thread wrapped around the assembly of the two resistive elements to form an inner cover, and a second covering thread wrapped around the inner cover to form an outer cover.

12. The wearable article of claim 1, wherein the assembly of the at least two resistive elements has a resistance in a range between about 150 Ω/m and about 180 Ω/m.

13. The wearable article of claim 1, wherein the at least one flexible strip is stitched to the flexible support.

14. The wearable article of claim 8, wherein the at least two covering threads are non-conductive threads comprising Polyvinyl Alcohol (PVA).

* * * * *